US005224730A

United States Patent [19]

Provence et al.

[11] Patent Number: 5,224,730

[45] Date of Patent: Jul. 6, 1993

[54] CROSS COUNTRY SKI BINDING

[75] Inventors: Marc Provence, Thorens-les-Glieres; Didier Rousset, Aix-les-Bains, both of France

[73] Assignee: Salomon S.A., Annecy Cedex, France

[21] Appl. No.: 678,143

[22] Filed: Apr. 1, 1991

[30] Foreign Application Priority Data

Apr. 6, 1990 [FR] France ..... 90 04631

[51] Int. Cl.[5] ..... A63C 9/08

[52] U.S. Cl. ..... 280/615; 280/634

[58] Field of Search ..... 280/607, 614, 615, 617, 280/618, 627, 634

[56] References Cited

U.S. PATENT DOCUMENTS 2,758,846 8/1956 Swensen ..... 280/615
4,957,304 9/1990 Diard et al. ..... 280/609
5,004,262 4/1991 Provence et al. ..... 280/615
5,033,767 7/1991 Provence et al. ..... 280/615

FOREIGN PATENT DOCUMENTS 0278859 8/1988 European Pat. Off. .
2638373 5/1990 France .
WO8403225 8/1984 World Int. Prop. O. .

*Primary Examiner*—Richard M. Camby
*Attorney, Agent, or Firm*—Sandler Greenblum & Bernstein

[57] ABSTRACT

Cross country ski binding, of the type comprising an elastic device constituted by a pair of flexion bars extending the length of the ski, in lateral grooves provided therein. According to the invention, there is provided at the rear a shoe control mechanism which is connected to the movable latching element provided in the front to block the tip of the shoe, the linkage between the element and the mechanism being formed by the flexion bars themselves, which are for this purpose translationally movable along the axis of the ski.

12 Claims, 5 Drawing Sheets

100
101
102
103
1
(P)
200
201
202
203
204
210
3
30
31
32
40
41
4
10
5
50
II
III
13
11
6
610
61
62
60
65
650
7
70
71
72
73
IV

CROSS COUNTRY SKI BINDING

BACKGROUND OF THE INVENTION

1. Field of the Invention

The present invention relates to a cross country ski binding.

2. Description of Background and Relevant Information

In a well-known manner, a cross country ski binding comprises means for retaining the tip of the shoe on the ski. These retention means comprise a movable latching element adapted to selectively occupy either a position for blocking the tip of the shoe (in a manner so as to allow for cross country skiing), or a position for freeing the tip of the shoe (permitting either insertion of the shoe, i.e., the positioning of the shoe on the ski, in the binding—or removal of the shoe—i.e., release of the shoe —).

For simplicity and safety of use, modern bindings possess "automatic" shoe insertion means permitting the user to put on his skis without manual intervention. For this purpose, it suffices to appropriately position the tip of the shoe in the binding, to exert a force of the foot from top to bottom on the ski, which serves to achieve blockage of the tip of the shoe in the binding by means of an appropriate mechanism.

A modern binding for a cross country ski comprises furthermore elastic means such as springs or rubber bumpers positioned to resist the movement of the foot during skiing. This cyclical movement comprises lifting of the heel combined with a pivoting at the position of the tip of the foot as well as a flexion of the foot at the position of the metatarsus. The elastic means are generally positioned in the binding, in front of the tip of the shoe; they absorb and then return to each step a certain quantity of energy, which allows for a controlled movement of the shoe and of the foot during walking.

In previous French patent applications filed by applicant and not yet published, No. 90 02824 and No. 90 02825, these elastic means comprise a pair of flexion bars which extend symmetrically under the shoe, substantially parallel to the ski, on both sides of its longitudinal plane of symmetry, while being inserted in lateral grooves provided in the sides of the ski.

A design of this type has the advantage of substantially reducing the bulkiness of the portion of the binding which is positioned in front of the tip of the shoe (because this portion need no longer contain the elastic means) and to ensure a good distribution of the masses. Furthermore, the flexion bars are particularly efficient in their function of absorbing and restoring energy.

SUMMARY OF THE INVENTION

The present invention has as an object to provide a cross country binding of the above type, which is equipped with means allowing for insertion of the shoe in an easy manner, and according to the preferred embodiments (but not limiting) - in an automatic manner.

To this end, and according to this invention, the flexion bars are translationally longitudinally movable and are connected kinematically through their front portion to the movable latching element and through their rear portion to a control mechanism, the connection being such that an activation of this mechanism brings—by means of movable bars —this latching element into the blockage position of the front of the shoe.

In the case where the apparatus is of the automatic shoe insertion type, this activation can consist simply of exerting on the mechanism a pressure force directed from top to bottom by means of the heel of the shoe, either directly or indirectly.

By virtue of this arrangement, the insertion of the shoe in the binding occurs in a particularly simple manner, because by acting at the position of the heel, the user can apply the entire weight of his body on the control mechanism; contrary to most automatic shoe insertion systems, the foot need not be pushed frontwardly; yet it is known that a frontward movement, which is not natural, serves to advance the ski, which renders insertion of the shoe relatively uncomfortable.

According to the invention, in addition to their function of absorbing and restoring energy, the flexion bars thus assure a transmission function of the movement between the control mechanism positioned adjacent to the heel and the latching mechanism situated at the tip of the shoe.

Preferably, the pressure force exerted from top to bottom on the control mechanism serves to pull the flexion bars towards the rear.

Furthermore, according to various preferred embodiments, which are nevertheless not limiting in terms of the invention:

the front portion of the flexion bar is affixed to a slide which is translationally guided on the ski;

this slide carries a pair of abutments serving to flexionally support the bars;

the linkage between the slide and the flexional bars is formed by means of an elastic cushion.

In a first embodiment of the invention, the rear portion of the flexion bars is affixed to a slide translationally guided on the ski, and whose displacement is controlled by an elbow mechanism.

Preferably, this elbow mechanism comprises a lever positioned at the rear of the slide, and connected to the latter by lateral cable portions, this lever being journalled on a pair of lateral swivels fixed with respect to the ski, and adapted to pivot towards the rear and downwardly through a pressure force from top to bottom exerted by the sole of the shoe on the upper surface of the lever.

These cable portions can preferably be positioned in rigid sheaths on which can be applied the sole of the shoe when its size is insufficient to rest on the upper surface of the lever.

In a second embodiment of the invention, the rear portion of the flexion bars can lift slightly above the level of the upper surface of the ski and the ends of these rear portions are affixed to a journalled double lever mechanism adapted to pull the bars towards the rear through a pressure force from top to bottom exerted by the sole of the shoe on the rear portions of the bars.

According to one embodiment, the journalled double lever mechanism comprises a first lever with which are affixed the rear ends of the flexion bars and a second lever which is journalled on the first lever, these two levers having the general form of "U" shaped stirrups which are embedded one in the other in a manner so as to cap the upper portion of the ski. The first lever is journalled on a transverse axis fixably mounted on the ski, this through a pair of guide slots provided in its lateral cheeks; the second lever is provided with a pair of guide ramps which are each connected to a latching cam and which are applied through elastic means against the fixed transverse axis; the shapes of the slots, the ramps and the cams are determined in a manner such that the displacement downwardly of the rear portions of the flexional bars, when the heel of the shoe rests thereon —causes the progressive retraction of the assembly of the two levers, followed by their blockage in the lower position.

The binding according to the invention is particularly adapted to receive a shoe whose tip has a latching shaft (or barrette) which is transverse, the movable latching element having in this case a semi-cylindrical shape adapted to clasp the latching shaft by applying it against a fixed complementary support element. This type of shoe, having a transverse latching shaft, is offered commercially by Applicant under the "SNS PROFIL" designation.

BRIEF DESCRIPTION OF THE DRAWINGS

Other characteristics and advantages of the invention will become clear from the description which follows, together with the annexed drawings which illustrate the preferred embodiments of the invention, in which.

Figure 8:
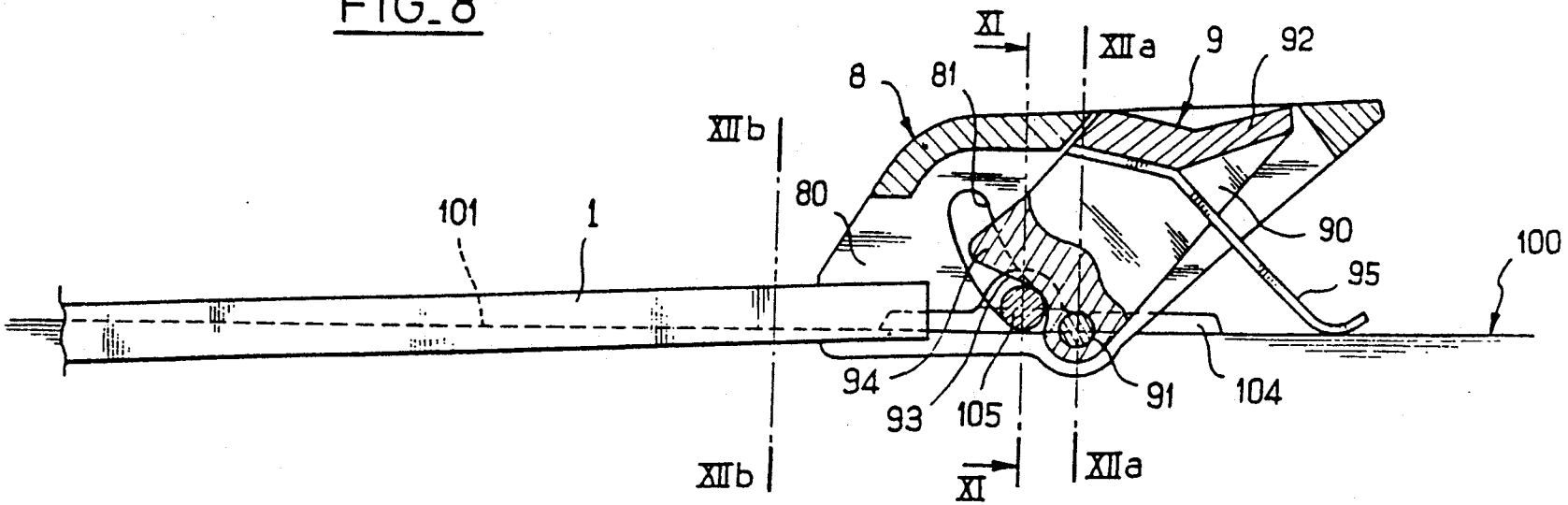
Figure 9:
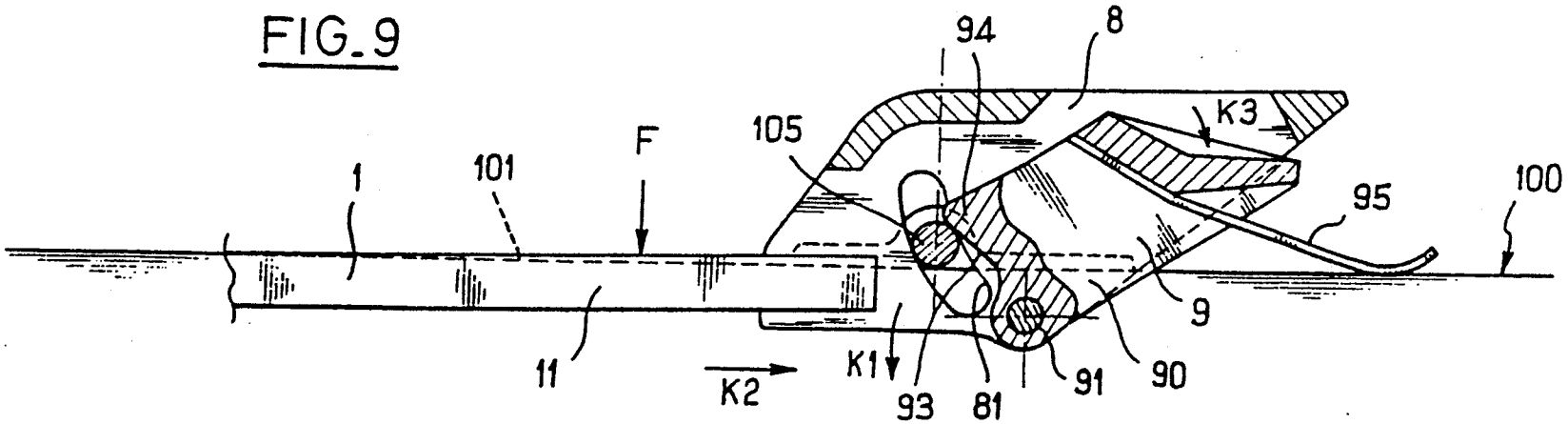
Figure 10:
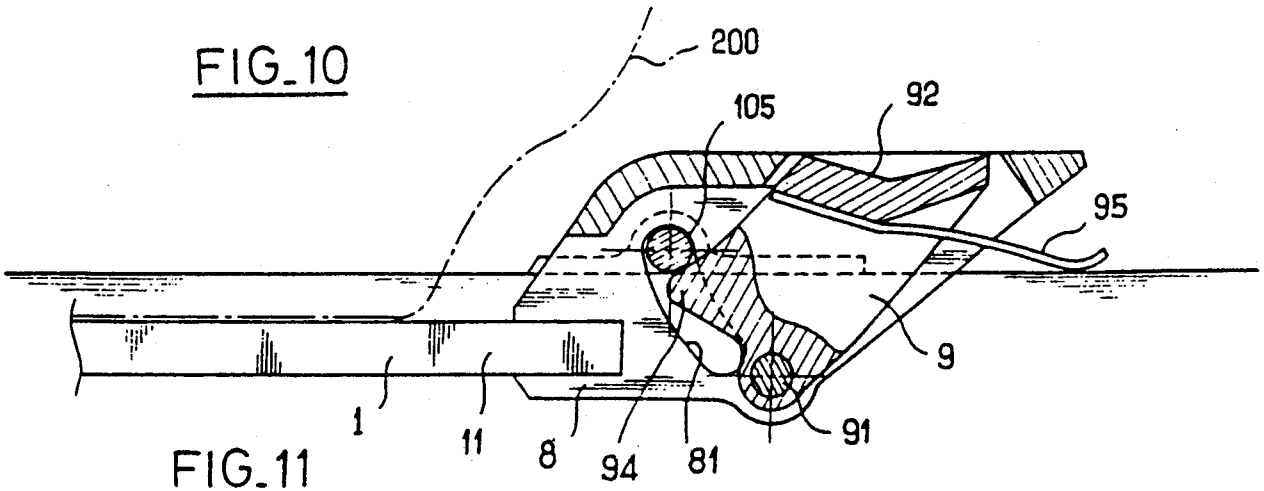
Figure 11:
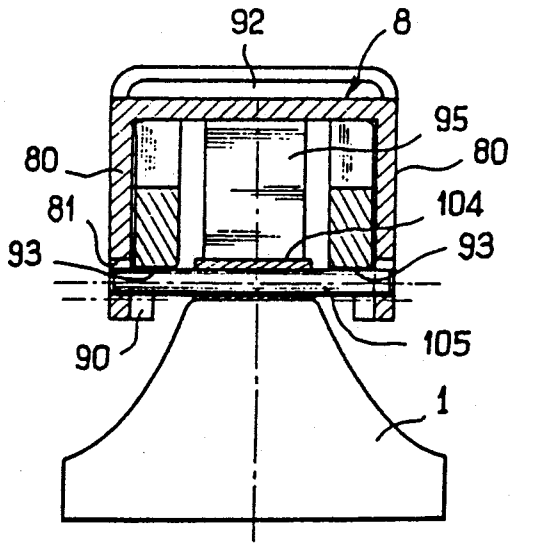
Figure 12:
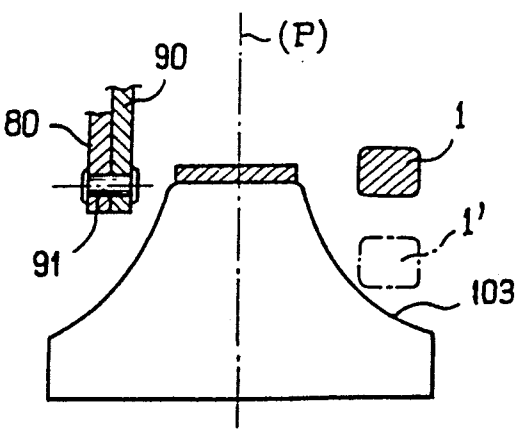

FIG. *7a* is a partial schematic view illustrating a movement of the shoe in the course of walking on the cross country ski which is equipped with the binding shown in FIGS. 1-7;

FIG. 8 illustrates, in side view and partially cut away, the rear portion of a second embodiment of a binding according to the invention, this rear portion being associated with a front portion which is identical or similar to that which forms the object of the first embodiment;

FIGS. 9 and 10 are views analogous to that of FIG. 8, illustrating a shoe insertion operation;

FIG. 11 is a transverse cross sectional view along plane XI—XI of FIG. 8; and FIG. 12 is a transverse cross sectional view whose left half corresponds to the cross sectional plane XIIa—XIIa and the portion to the right of the cross sectional plane XIIb—XIIb of FIG. 8.

In the side view Figures, the front of the ski is conventionally positioned on the left.

DESCRIPTION OF PREFERRED EMBODIMENTS

Figures 1, 2:
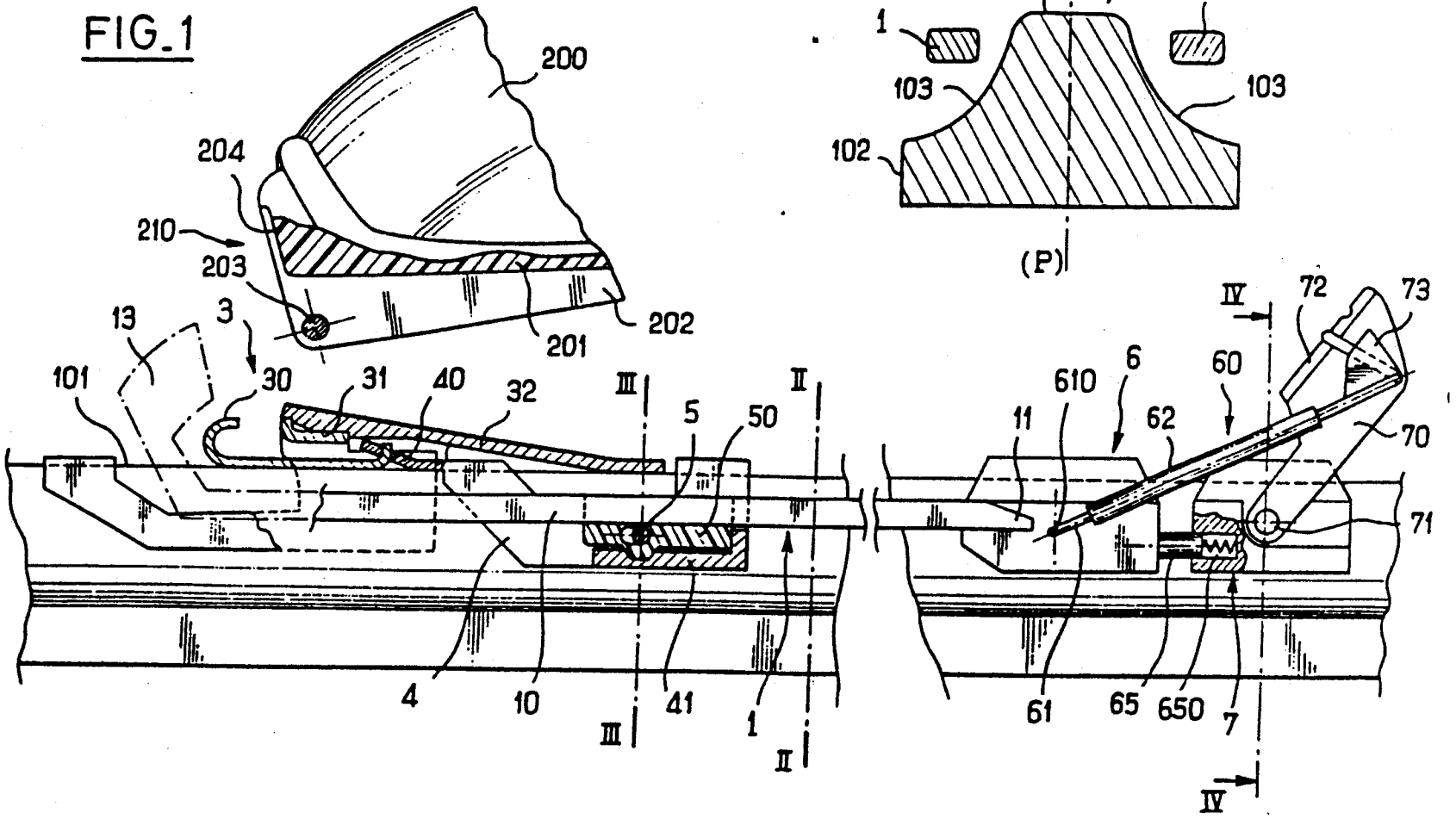
FIG. 1 is a side view, partially cut away, of a first embodiment of the binding of the invention which is mounted on a ski, the figure likewise illustrates the front portion, partially cut away, of the shoe before being positioned in the binding.
FIG. 2 is a transverse cross section of the ski and of the binding according to the plane of cross section II—II of FIG. 1.

As seen in FIGS. 1 and 2, ski 100, equipped with the binding, has a transverse cross section of a particular shape. At its lower portion, it has vertical side planes 102; its upper surface 101 has a width which is substantially less than its lower surface (sliding surface). For this purpose, the sides of the ski are substantially scalloped at least over the entire length of the portion of the ski corresponding to the zone receiving the shoe. Reference numeral 103 designates the lateral scalloped walls of the ski, which assure the connection between the sides 102 and the surface 101. This wall has a concave shape, having a contour approximately corresponding to an arc of a circle.

As is explained in the prior patent applications which are cited above, the elastic means which are part of this binding consist of a pair of flexion bars numbered 1 which extend on both sides of the longitudinal, vertical P plane of the ski, symmetrically with respect thereto and being positioned in the spaces constituted by these scallops. As seen more particularly in FIG. 2, the bars 1 have a rectangular transverse cross section, preferably having rounded angles, which are not sharp. The bars 1 are formed out of a material which gives them a certain elasticity in flexion; it is preferably a synthetic material, which may or may not be a composite, for example having a base of glass or carbon fibers.

The front portion of bars 1, designated by reference 10, is connected to retention means of the tip of the shoe, i.e., the front portion of the binding, reference numeral 3, while their rear portion 11 is connected to a shoe control mechanism, reference numerals 7 and 8, which constitute the rear portion of the binding.

The front portions 10 of bars 1 are affixed to a slide 4 which has a complementary shape to that of the upper portion of the ski and rests thereon with a possibility of longitudinal sliding.

Figure 3:
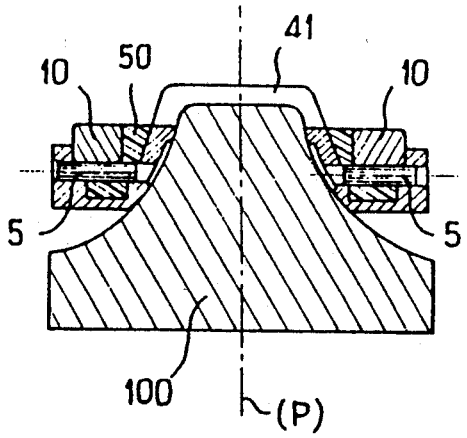
FIGS. 3 and 4 are respectively views in transverse cross section and in transverse cross section along planes III—III and IV—IV of FIG. 1.
Figure 4:
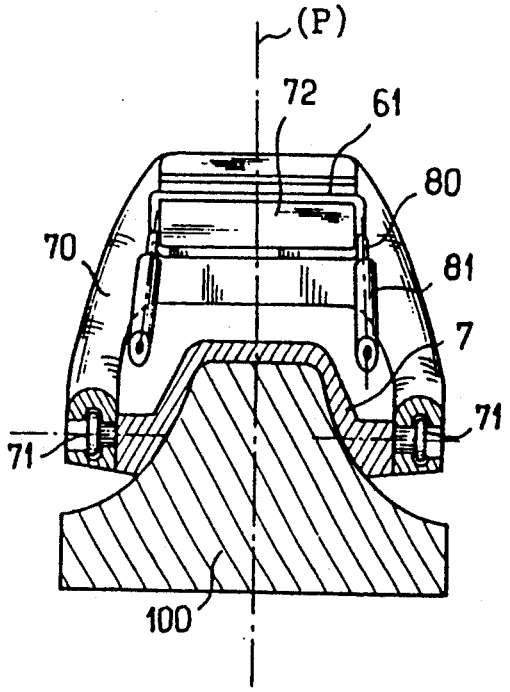
Figure 7A:
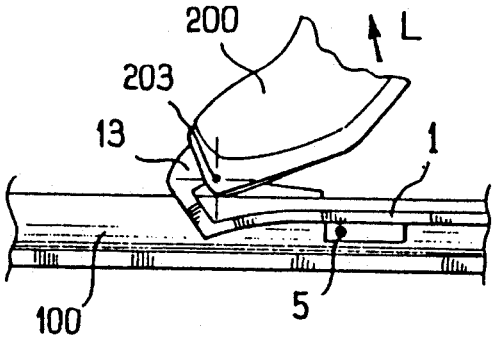
FIGS. 5 and 7 are side views analogous to FIG. 1 which illustrate the rear portion of the binding during and after insertion of-the shoe.
Figure 5:
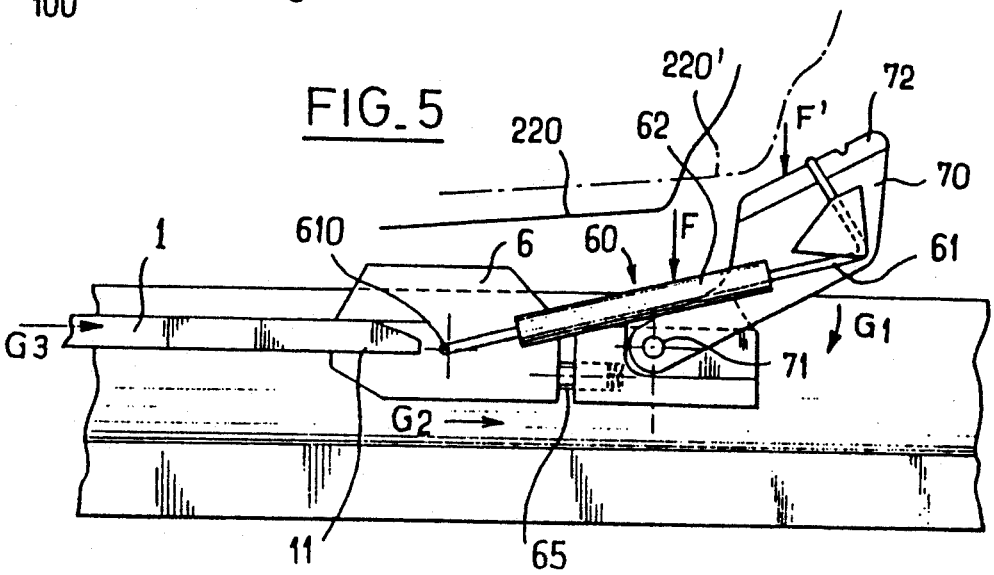

This slide 4 comprises a zone 41 whose lateral portions, in the form of containers, each receive one of bars 10 (see in particular FIG. 3).

Each of these lateral portions carries an abutment 5 in the form of a cylindrical shaft positioned transversely with respect to the ski and which serves as a flexional support for the bar 1 associated therewith. Furthermore, this portion carries an elastic sleeve or bumper 50, made out of synthetic rubber for example, through which a shaft 5 extends; the bar 10 is fixed by gluing to bumper 50.

By virtue of this arrangement, bar 1 can thus be displaced elastically, over a limited extent, with respect to slide 4; this displacement occurs by deformation of elastic bumper 50; it will be noted that shaft 5 extends through the bumper through an elongated hole, which allows for this relative displacement.

At its front portion, slide 4 is extended by an appendage 40 which is driven with a movable latching element 30 resting on the surface 101. This can be displaced longitudinally on the ski by following the movement of the bars 1. It is guided for this purpose in a fixed element 31 which is mounted on the ski by appropriate known means, for example, gluing or screwing. The element 31 and the appendage 40 are covered by a cuff 32 in the form of a rib, which is likewise fixed to the ski, and adapted to serve as a lateral guide for the shoe on the ski; for this purpose, the cuff 32 has a substantially trapezoidal cross section, whose small side is directed upwardly, this form being complementary to that of the guide groove 202 formed in the sole 201 of the cross country ski shoe 200.

This shoe 200 is of the same type as the "SNS PROFIL" shoe referred to above; at the lower portion of its tip 210 is positioned a barrette or transverse shaft 203, which extends through the rib 202; it is this barrette 203 which serves for hooking the shoe in the binding, while serving as a pivot axis of the shoe with respect to the ski during skiing. Tip 210 has a front planar portion 204 adapted to be supported against an appropriate energy absorption and restitution element.

The front portion of the latching element 30 is curved towards the rear and has a semi-cylindrical shape, whose diameter corresponds substantially to that of the latching shaft 203. Upon simple observation of FIGS. 1 and 6, it is seen that if one positions the shaft 203 between the elements 30 and 31, and one displaces the element 30 towards the rear, shaft 203 is imprisoned between these two elements and consequently the tip of the shoe will be affixed to the ski.

The front end of bars 1 carries a support element 13 which passes transversely above the ski, and is adapted to be applied against the front surface 204 of the tip of the shoe. Element 13, which is shown in dot-dash-lines in the Figures, preferably has on its rear surface a garnishing made of elastic material, for example made out of synthetic rubber, by which it is applied against the shoe.

The rear end 11 of the bars is embedded and affixed, through appropriate means, for example by means of a screw, to a slide 6 which caps ski 100 and can slide freely thereon.

At the rear of the slide 6 is mounted an element 7 of a similar shape, which caps the ski. However, element 7 is affixed on the ski, for example by gluing. The upper portions, i.e., which are located above the level of the upper surface 101 of the ski, as well as on the edges of this upper surface, of the portion 41 of slide 6, and of element 7, all have in transverse cross section an identical trapezoidal contour, which is complementary to that of the longitudinal guidance groove 202 provided in the sole of the shoe.

In addition to their function for insertion of the shoe, elements 6 and 7 have consequently an active role in the lateral retention of the shoe on the ski.

Slide 6 has two lateral projections 65 directed towards the rear and guided in holes of corresponding cross section provided in front of element 7. These projections thus assure the guidance of the slide 6 with respect to the fixed element 7.

Small compression springs 650 tend permanently to make the projections 65 extend out of their hole and thus to push the slide 6 frontwardly.

Element 7 carries a pivoting lever 70 which has, a generally "U" shape which is inverted, whose ends include lateral cheeks which are journalled on the element 7 through a pair of lateral transverse swivels 71. The linkage between the slide 6 and the fixed element 7 is assured by a cable 61, which is for example metallic. This cable has the form of an arc whose ends are attached at point 610, by appropriate means which are not shown, on the sides of slide 6. At the position of lever 70, cable 61 is guided and retained in lateral excess thicknesses 71 provided on the sides of this lever. This lever has an upper surface which is normally directed obliquely upwardly and towards the rear of the ski while being positioned above it, as is shown in FIG. 1. This upper surface preferably has a flexible garnishing 72, for example made of polyurethane, having one or more cable retention cutouts on the surface of lever 70.

It is preferred to provide a plurality of offset cutouts, for example two cutouts, in order to be able to compensate if desired for the inevitable relaxation of the cable in the course of time.

The two lateral portions of cable 61 are positioned in a pair of sheaths 62 which are cylindrical and rigid, for example made out of plastic material.

We will now explain the operation of performing the insertion of the shoe into this binding.

In order to insert the shoe into the binding, the user begins—if this is not already the case—by bringing into the state shown in FIG. 1, latching element 30 spaced from element 31 (that is to say advanced) and lever 70 lifted.

The ski being positioned on the ground, the user has the tip of his shoe in an inclined position with the tip downwardly above the front portion 3 in a manner so as to position the latching shaft 203 between the elements 30 and 31. Shaft 203 being supported against curved element 30, the skier lowers his heel towards the ski. Depending on the size of the shoe, whose heel is shown as 220 in FIG. 5, which may be relatively small or large, this heel will be supported either on the sheaths 62 (as is shown in the Figure by the arrow F) or on the garnishing 72 of the lever 70 (as is shown by the arrow F'). In the two cases, this pressure force from top to bottom causes the pivoting of lever 70 around swivels 71 (arrow G1). The deformable triangle constituted by the lever 70 on the one hand and by the assembly 60 of the sheaths 62 and the lateral portions of the cable 61 on the other hand cause thus, by an elbow effect, the displacement towards the rear of slide 6 (arrow G2) and, correspondingly, the traction of the two bars 1 towards the rear (arrow G3).

Figure 6:
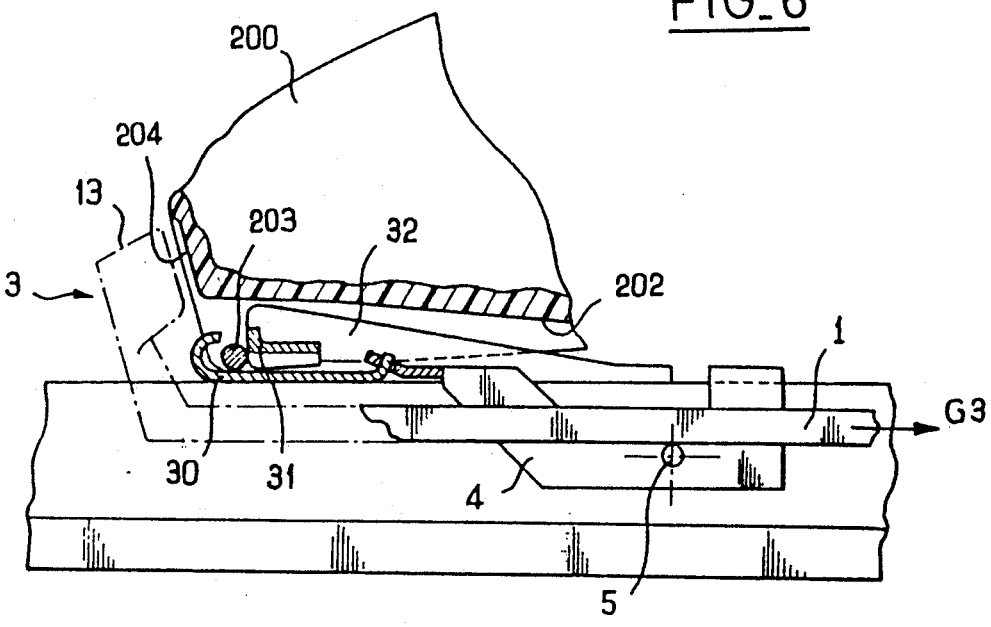
FIG. 6 is a similar view illustrating the front portion of the binding in the course of insertion of the shoe.

As will be easily understood by observing FIG. 6, this movement G3 causes a corresponding movement of the latching element 30 towards the rear, which serves to imprison the latching shaft 203 between this element 30 and the fixed element 31. At the same time, the portion 13, which retracts also at the same time as the bars 1, is applied against the front zone 204 of the shoe. This shoe is thus perfectly affixed to the ski through its tip by means of barrette 203, and is supported through zone 204 against the elastic resistance means which are constituted by the flexion bars 1.

Figure 7:
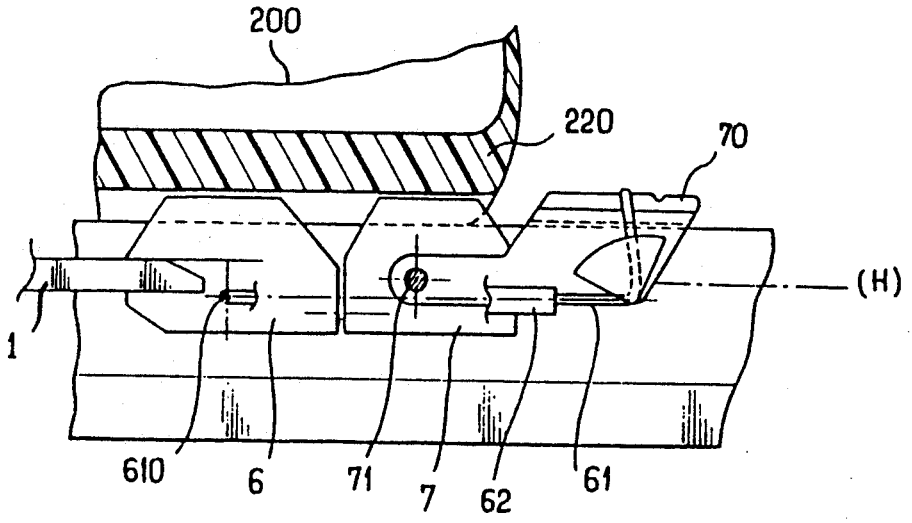

Referring to FIG. 7 which illustrates the position of the control mechanism at the end of insertion of the shoe, it is observed that the lever 70 is applied against the ski, in a substantially horizontal position. In this position, the portions of cable 61 are positioned likewise approximately horizontally, at a level lower than the axis 71. Under these conditions, any tractional force towards the front on bars 1 thus causes at the level of the position a force whose direction passes under the axis 71 and which develops consequently on the lever 70 a moment tending to lower it. In the course of insertion of the shoe, the elbow system 60–70 thus crosses an equilibrium or over-center point which prevents any untimely unlatching of the binding in the course of skiing.

To remove the shoe, it suffices for the user to manually lift lever 70, which serves to allow for the free sliding towards the front of the bar 1 and the element 30, thus allowing for the liberation of the shoe. The presence of springs 650 (which have been preliminarily compressed) favors the movement towards the front of the slide 6 at the beginning of removal of the shoe.

The elasticity of the linkage of the bars 1 with the slide 4 makes it possible to compensate where necessary bar the tolerances of manufacture and allows furthermore for the insertion of the shoe into the binding even if a certain thickness of snow is attached to the sole of the shoe.

FIG. *7a* schematically shows the manner in which skiing on the cross country ski is performed. During skiing, the foot is lifted in a cyclical fashion, which is shown by the arrow L. This movement combines a rotation of the tip of the shoe 200 around the latching barrette 203, with a flexion of the foot at the level of the metatarsus. During skiing, the front portion of the shoe, which is applied against the support element 13, causes deformation in flexion of the front end of the bars 1 beyond the abutments 5. The bars 1 thus absorb the energy furnished by the user in the course of the lifting of the foot, while permitting the control of this movement, then restoring a portion of this energy in the course of the following phase during which the shoe is replaced on the ski.

During skiing, the cuff 32 in the form of a rib constantly assures the lateral guidance of the tip of the shoe with respect to the ski by cooperating with the sides of the groove 202. Likewise, when the shoe is flat on the ski, which is the case in particular when going downhill, the rear elements 6 and 7—which serve the role of small heels—assure the centering of the heel on the ski.

The shoe insertion mechanism which is the object of the second embodiment shown in FIGS. 8–12, essentially comprises a set of two levers 8 and 9 which are positioned just to the rear of the shoe (not shown).

A plate 104 mounted on the upper surface of the ski, and affixed thereto by appropriate means (screwed or glued, for example) carry a transverse axis 105. The latter is placed just above the ski. The two levers 8 and 9 have an inverted "U" shaped stirrup which are embedded in one another. Lever 8 is positioned to the exterior of lever 9, and these two levers are journalled on one another by lateral swivels 91 positioned transversely and normally positioned slightly to the rear of the axis 105, slightly beneath the level of the upper surface 101 of the ski. The lateral cheeks 80 of the lever 8 each have an oblong slot 81, in the form of an arc-shaped slot, of large radius, whose center of curvature is directed towards the rear and upwardly, as is clearly shown in FIGS. 8, 9 and 10. Axis 105 is engaged through its ends in the slots 81.

The center lever 9 has lateral cheeks 90 which are each provided with a guide ramp 93 which is supported against the axis 105. These ramps are each connected to a latching cam 94 in the form of a prominent "nose."

An elastic flexion plate 95 carried by lever 9 is supported against the upper surface 101 of the ski and tends to lift the lever 9 and thus to apply the ramp 93 against axis 105.

The rear ends 11 of bars 1 are embedded and affixed in the front portion, in the form of a jaw, of cheeks 80 of lever 8.

Through their front portion, not shown, bars 1 are connected to the front portion of the binding which can be similar to that described with reference to FIG. 1.

However, in the second embodiment, the linkage of the bars 1 to their front end allows for a slight rocking of these bars in the vertical plane, their rear end can be lifted to reach a more elevated level than the surface 101 of the ski, as is visible in FIG. 8.

This position of the bars, and of the rear mechanism shown in FIG. 8, corresponds to the position where the shoe is not inserted in the binding.

To put on his skis, the user positions the tip of the shoe in the front portion of the binding, and presses the heel of the shoe downwardly against the ski. The rear portion of the sole is thus supported on the bars 1 as is shown by the arrow F in FIG. 9. This force F makes lever 8 pivot downwardly (arrow K1 which serves, through cooperation of the fixed axis 105 with the edge of the slot 81, to press this lever towards the rear. The bars 1, affixed to lever 8, are thus likewise pulled towards the rear (arrow K2). At the same time, ramp 93 which is likewise supported against the fixed axis 105, pivots the lever 9 towards the rear (arrow K3) by making the spring blade 95 flex.

Beyond a certain extent of pivoting K3, the projecting portion 94 crosses the level of axis 105 which serves to cause the relative latching of the two levers 8 and 9, as is shown in FIG. 10. In this position which corresponds to the position where the shoe is inserted, the bars are substantially horizontal. In the course of the movements which have just been described, the displacement towards the rear of the bars 1 has thus provided the latching element to the front portion of the binding in its position of blocking the tip of the shoe, in a manner similar to that of the first embodiment.

To remove the shoe from the binding, it suffices to lower the lever 9 downwardly in a manner so as to space the cam 94 from the fixed axis 105, which allows for a lifting of the two levers under the effect of the spring blade 95, while making the foot flex (through lifting of the heel) to pull the bars frontwardly. The bars 1 are displaced frontwardly (while their rear end is lifted), which causes the latching element to advance, assuring the liberation of the tip of the shoe. It will be noted that the upper surface of lever 9 has a small trough 92 provided to receive the tip of a ski pole for purposes of removing the shoe.

While the principle of the invention is particularly adapted to an automatic insertion binding, it is evident that one does not go beyond the scope of the invention by providing at the rear a non-automatic shoe insertion mechanism which is manually controlled, whose activation achieves the displacement of the bars.

The instant application is based upon French Application 90.04631 filed Apr. 6, 1990 in France, the disclosure of which is hereby specifically incorporated by reference thereto, and the priority of which is hereby claimed under 35 U.S.C. 119.

Finally, although the invention has been described with reference to particular means, materials and embodiments, it is to be understood that the invention is not limited to the particulars disclosed and extends to all equivalents within the scope of the claims.

What is claimed is:

1. A binding for a cross country ski, said binding comprising retention means for retaining the tip of the shoe on the ski, said retention means comprising a movable latching element, said latching element being selectively movable between a blocking position and a position for freeing the tip of the shoe, elastic energy absorption and restoration means allowing for the controlled flexion of a foot during cross country skiing, said elastic energy absorption and restoration means comprising a pair of flexion bars which extends symmetrically under the shoe, substantially parallel to the ski, on both sides of a longitudinal plane of symmetry, and which are positioned in spaces provided in the sides of the ski, wherein said flexion bars are translationally longitudinally movable and are kinematically connected through their front portions to the movable latching element and through their rear portions to a control mechanism, the connection being such that an activation of said control mechanism makes it possible to bring, by means of the said movable flexion bars, the latching element into said blocking position for blocking the tip of the shoe.

2. The binding as defined by claim 1, for automatic insertion of the shoe, wherein activation comprises exerting a pressure force from top to bottom on the control mechanism, either directly or indirectly by means of the heel of the shoe.

3. The binding as defined by claim 2, wherein the pressure force exerted from top to bottom on the control mechanism serves to pull the flexion bars towards the rear of the ski.

4. The binding as defined by claim 1, wherein the front portion of each of the flexion bars is affixed to a slide which is guided translationally on the ski.

5. The binding as defined by claim 4, wherein said slide carries a pair of abutments serving as a support for flexion of said flexion bars.

6. The binding as defined by claim 4, wherein the connection linkage between the slide and the bars comprises an elastic cushion.

7. The binding as defined by claim 3, wherein the rear portion of each of the flexion bars is affixed to a slide guided translationally on the ski, and wherein the displacement of said glide is controlled by an albow mechanism.

8. The binding as defined by claim 7, wherein the elbow mechanism comprises a lever positioned at the rear of a slide and connected to said slide by lateral cable portions, said lever being journalled on a pair of lateral swivels affixed with respect to the ski, and adapted to pivot toward the rear and downwardly as a result of a pressure force from top to bottom exerted by the sloe of the shoe on the upper surface of the lever.

9. The binding as defined by claim 8, wherein said cable portions are positioned in rigid sheaths, on which can be applied to sole of the shoe when its tip is of insufficient length to rest on the upper surface of the lever.

10. The binding as defined by claim 3, wherein the rear portion of each of the flexion bars can lift slightly above the level of the upper surface of the ski, and wherein the ends of said rear portions are affixed to a mechanism having journalled levers adapted to pull the flexion bars towards the rear as a result of a pressure force from top to bottom exerted by the sole of the shoe on the rear portions of the bars.

11. The binding as defined by claim 10, wherein said mechanism includes journalled levers said journalled levers comprising a first lever to which are affixed the rear ends of the flexion bars, and a second lever which is journalled on the first lever, said first and second levers having the general form of stirrups in a U-shape which are nested within one another in a manner so as to cover the upper portion of the ski, and wherein:

the first lever is journalled on a transverse axis fixedly mounted on the ski by means of guide slots provided in lateral cheeks thereof, the second lever is provided with a pair of guide ramps which are each connected to a latching cam, and are applied by elastic means against the fixed transverse axis;

the shapes of the slots, ramps, and cams being such that displacement downwardly of the rear portions of the flexion bars causes progressive retraction of the assembly of the two levers followed by their blockage in the lowered position.

12. The binding as defined by claim 1, wherein said binding is adapted to receive a shoe whose tip has a transverse latching shaft, said movable latching element having a semi-cylindrical shape adapted to clasp said latching shaft by applying it against a fixed complementary support element.

* * * * *